US006748710B2

(12) United States Patent
Gresham et al.

(10) Patent No.: US 6,748,710 B2
(45) Date of Patent: Jun. 15, 2004

(54) PARTITION TRIM HAVING FUNCTIONAL ASPECTS

(75) Inventors: David M. Gresham, E. Grand Rapids, MI (US); James N. Ludwig, E. Grand Rapids, MI (US); Karl J. Mead, E. Grand Rapids, MI (US); Karl Heinz Mueller, E. Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/113,139

(22) Filed: Mar. 29, 2002

(65) Prior Publication Data

US 2003/0182885 A1 Oct. 2, 2003

(51) Int. Cl.[7] ..... E04B 2/74; E04F 19/00; E04H 6/00; E04C 2/38

(52) U.S. Cl. ..... 52/242; 52/36.4; 52/36.5; 52/716.1

(58) Field of Search ..... 52/242, 36.1, 364, 52/36.5, 287.1, 288.1, 716.1, 238.1, 239, 466, 468, 783.1; 160/135; 211/87.01, 94.07

(56) References Cited

U.S. PATENT DOCUMENTS

| | | | | | |
|---|---|---|---|---|---|
| 3,195,698 | A | | 7/1965 | Codrea | |
| 3,261,625 | A | | 7/1966 | Cripe | |
| 3,276,175 | A | * | 10/1966 | Birum | 52/239 |
| 3,295,283 | A | * | 1/1967 | Griffith | 52/481.1 |
| 3,425,171 | A | * | 2/1969 | Propst | 160/135 |
| 3,534,517 | A | * | 10/1970 | Kann | 52/239 |
| 3,733,759 | A | | 5/1973 | Schulte et al. | |
| 3,778,175 | A | | 12/1973 | Zimmer | |
| 3,807,102 | A | | 4/1974 | Albinson et al. | |
| 3,828,495 | A | | 8/1974 | Law | |
| 3,849,962 | A | | 11/1974 | Albinson et al. | |
| 3,901,612 | A | | 8/1975 | Canin | |
| 3,982,370 | A | | 9/1976 | Buffington | |
| 4,073,113 | A | | 2/1978 | Oudot et al. | |
| 4,109,429 | A | | 8/1978 | Whisson | |
| 4,192,106 | A | | 3/1980 | Hell | |
| 4,269,005 | A | | 5/1981 | Timmons | |
| 4,360,240 | A | | 11/1982 | Koncelik et al. | |
| 4,366,999 | A | | 1/1983 | Koncelik et al. | |
| 4,416,093 | A | | 11/1983 | Salkeld et al. | |
| 4,433,630 | A | | 2/1984 | Laborie | |
| 4,434,900 | A | | 3/1984 | Cook | |
| 4,443,979 | A | | 4/1984 | Varon et al. | |
| 4,448,003 | A | | 5/1984 | Hasbrouck | |
| 4,450,655 | A | * | 5/1984 | Rosenthal et al. | 52/36.4 |
| 4,531,859 | A | | 7/1985 | Bettigole | |
| 4,560,130 | A | | 12/1985 | Schwartz | |
| 4,571,906 | A | | 2/1986 | Ashton | |
| 4,677,794 | A | | 7/1987 | Parron et al. | |
| 4,684,425 | A | | 8/1987 | Bannister | |

(List continued on next page.)

OTHER PUBLICATIONS

Exhibit A discloses a product catalog entitled "80/20 The Industrial Erector Set", published by 80/20 Inc., Columbia City, Indiana, disclosing a modular system using slotted beams for connections.

*Primary Examiner*—Carl D. Friedman
*Assistant Examiner*—Kevin McDermott
(74) *Attorney, Agent, or Firm*—Price, Heneveld, Cooper, DeWitt & Litton, LLP

(57) ABSTRACT

A partition and wall system includes a partition with trim piece(s) securely attached to a top edge and vertical side edges of the partition. One or both of the trim piece(s) have a T-slot running along their length, to which accessories can be secured by use of T-fasteners that extend into the slot and engage blind surfaces at a bottom of the slot. The accessories include such things as screens, hooks, lights, panels, shelves, wire managers, utility-using devices, and the like, and can be easily arranged by office workers in optimal and customized arrangements, thus improving efficiency and adding function and value to the office arrangement.

48 Claims, 9 Drawing Sheets

U.S. PATENT DOCUMENTS 4,689,929 A * 9/1987 Wright ..... 52/239
4,719,731 A * 1/1988 Ravotti et al. ..... 52/239
4,841,699 A 6/1989 Wilson et al.
4,856,253 A * 8/1989 Jou ..... 52/718.05
4,891,922 A 1/1990 Hozer et al.
4,947,601 A 8/1990 McGuire
4,949,519 A 8/1990 Jeffers
5,025,603 A 6/1991 Johnson
5,056,577 A 10/1991 DeLong et al.
5,069,263 A 12/1991 Edwards
5,070,666 A 12/1991 Looman
5,086,606 A 2/1992 Finses
5,101,606 A 4/1992 Meru
5,125,193 A 6/1992 Beaulieu
5,134,826 A 8/1992 La Roche et al.
5,155,960 A 10/1992 Shaanan
5,175,969 A 1/1993 Knauf et al.
5,184,441 A 2/1993 Balfanz, Jr.
5,247,773 A 9/1993 Weir
5,274,970 A 1/1994 Roberts
5,277,512 A 1/1994 Dwillies
5,287,666 A 2/1994 Frascaroli et al.
5,339,576 A 8/1994 Fussler
5,341,615 A 8/1994 Hodges et al.
5,377,466 A 1/1995 Insalaco et al.
5,394,658 A 3/1995 Schreiner et al.
5,433,046 A 7/1995 MacQuarrie et al.
5,474,402 A 12/1995 Wu
5,479,747 A 1/1996 Wu
5,524,394 A 6/1996 Szabo, Sr. et al.
5,560,169 A 10/1996 Palmer
5,600,926 A 2/1997 Ehrlich
5,634,300 A 6/1997 Huebner et al.
5,638,650 A 6/1997 Edwards
5,642,593 A 7/1997 Shieh
5,737,893 A 4/1998 Rossiter et al.
5,758,466 A 6/1998 Tucker
5,803,146 A 9/1998 Boon
5,816,001 A 10/1998 Goodman et al.
5,826,639 A 10/1998 Miller
5,831,211 A 11/1998 Gartung et al.
5,839,240 A 11/1998 Elsholz et al.
5,852,904 A 12/1998 Yu et al.
5,875,596 A 3/1999 Muller
5,901,523 A 5/1999 Tasi
5,960,599 A 10/1999 Schmidt et al.
5,970,675 A 10/1999 Schray
5,974,742 A 11/1999 Schreiner et al.
6,052,958 A 4/2000 Miedema et al.
6,098,358 A 8/2000 Waalkes et al.
6,112,472 A 9/2000 Van Dyk et al.
6,112,485 A 9/2000 Beyer et al.
6,125,600 A * 10/2000 Bastian ..... 52/220.7
6,167,664 B1 1/2001 Reuter et al.
6,223,485 B1 5/2001 Beck et al.
6,230,459 B1 5/2001 Jeffers et al.
6,244,002 B1 6/2001 Martin
6,250,032 B1 6/2001 Davis et al.
6,260,324 B1 7/2001 Miedema et al.
6,276,103 B1 8/2001 Waalkes et al.
6,279,278 B1 8/2001 Morris et al.
6,282,854 B1 9/2001 Vos et al.
6,295,764 B1 10/2001 Berridge et al.
6,301,846 B1 10/2001 Waalkes et al.
6,314,687 B1 11/2001 Schondelmayer et al.
6,330,773 B1 12/2001 MacDonald et al.
6,367,213 B1 4/2002 Reuter et al.
2002/0088188 A1 * 7/2002 Chang ..... 52/238.1
2002/0108330 A1 * 8/2002 Yu et al. ..... 52/238.1
2003/0051415 A1 * 3/2003 Remelts ..... 52/36.1

* cited by examiner

PARTITION TRIM HAVING FUNCTIONAL ASPECTS

BACKGROUND

The present invention relates to partitions having trim pieces covering one or more top and vertical side edges of the partitions.

Partition systems are often used to subdivide building space. It is important that the partitions be aesthetically trimmed out to look their best, since partitions are highly visible and can dominate the aesthetics of an office or work area. Further, the trim should preferably be securely attached and also should provide durable protection for edges of the partition so that the partitions not only last a long time, but also look good for a long time. Still further, the trim should preferably not interfere with the partition system, such that the trim permits rearrangeability and reconfiguration of the partitions. The trim should not add an excessive number of parts and expensive pieces, and preferably should not complicate interconnection of partitions and trimming out of the rearranged pieces. However, there is tension between these different concepts, and there is no easy solution. In particular, it is difficult to maintain trim alignment in long runs of partitions and at 90-degree corners in partitions, while also providing releasability and removability of the trim. This problem becomes worse when trim is used for more than merely providing a visually clean surface, as discussed below.

Modern offices are becoming smaller and smaller, and there is an increasing effort to optimize use of office space as well as to make maximum use of every bit of available space. Further, business owners have found that it can be very important to allow workers to customize their areas and make the areas their "own", because workers will tend to work harder, have a better attitude, and therefore be more productive. Designers have focused their attention on the area in front of partitions and on the partition itself for many years. However, the area in and around the edges of partitions has often been ignored, with many designers taking the position that it must be kept visually "clean" and the trim must be kept absolutely as low-cost as possible. Consistent with that philosophy, manufacturers of partitions spend much of their resources in making partition frames as strong as possible, and then trim out and cover the partition frames with less expensive materials. However, the low-cost non-structural trim can be a barrier to attaching accessories in and around edges of the partition (i.e. in the plane of the partition), since by definition, the trim covers up the edges of the partition so that the partition "looks good". Some partition systems include brackets that extend around the edge trim and that are connected to the partition frame. Usually, the brackets have a thin section for fitting through a narrow access slit past the trim into the partition frame. However, the narrowness of the access slit causes an increase in a length of the bracket, causing the accessory to be spaced away from the partition frame, such that these style brackets have to be beefed up in order to provide the structural support required for supporting accessories having significant weight. Also, keeping in mind that trim covers edges of a partition, the trim tends to drive the accessories away from positions immediately adjacent the edges of the partition. Accordingly, an apparatus is desired solving the aforementioned problems and having the aforementioned advantages.

SUMMARY OF THE PRESENT INVENTION

In one aspect of the present invention, a partition system includes a partition having opposing faces defining front and rear planes, a top edge, and vertical side edges, and at least one trim piece attached to the partition and extending along at least one of the top edge and side edges, the trim piece aesthetically covering at least a portion of the one edge. The trim piece has a body extending between the front and rear planes with an attachment feature located between the planes that is adapted to receive a fastener for securing an accessory to the body of the trim piece. The trim piece is made of a structural material capable of carrying and supporting the accessory during use of the accessory.

In another aspect of the present invention, a partition system includes a partition having a top edge and vertical side edges, the top edge being elongated and extending across the partition between the vertical side edges. The top edge includes an upper surface that defines a slot positioned between front and rear portions of the top edge. An accessory with a fastener extends into the slot to retain the accessory to the partition.

In another aspect of the present invention, a trim system is provided that is configured and adapted to cover a side or top edge of a partition or wall. The trim system includes a trim piece having a width selected to at least partially cover the edge. The trim piece is elongated and has a transverse section defining a longitudinally-extending slot with at least one blind surface. An accessory with a fastener is provided that is shaped to fit into the slot and engage the blind surface to retain the accessory to the trim body.

These and other aspects, objects, and features of the present invention will be understood and appreciated by those skilled in the art upon studying the following specification, claims, and appended drawings.

Figure 1:
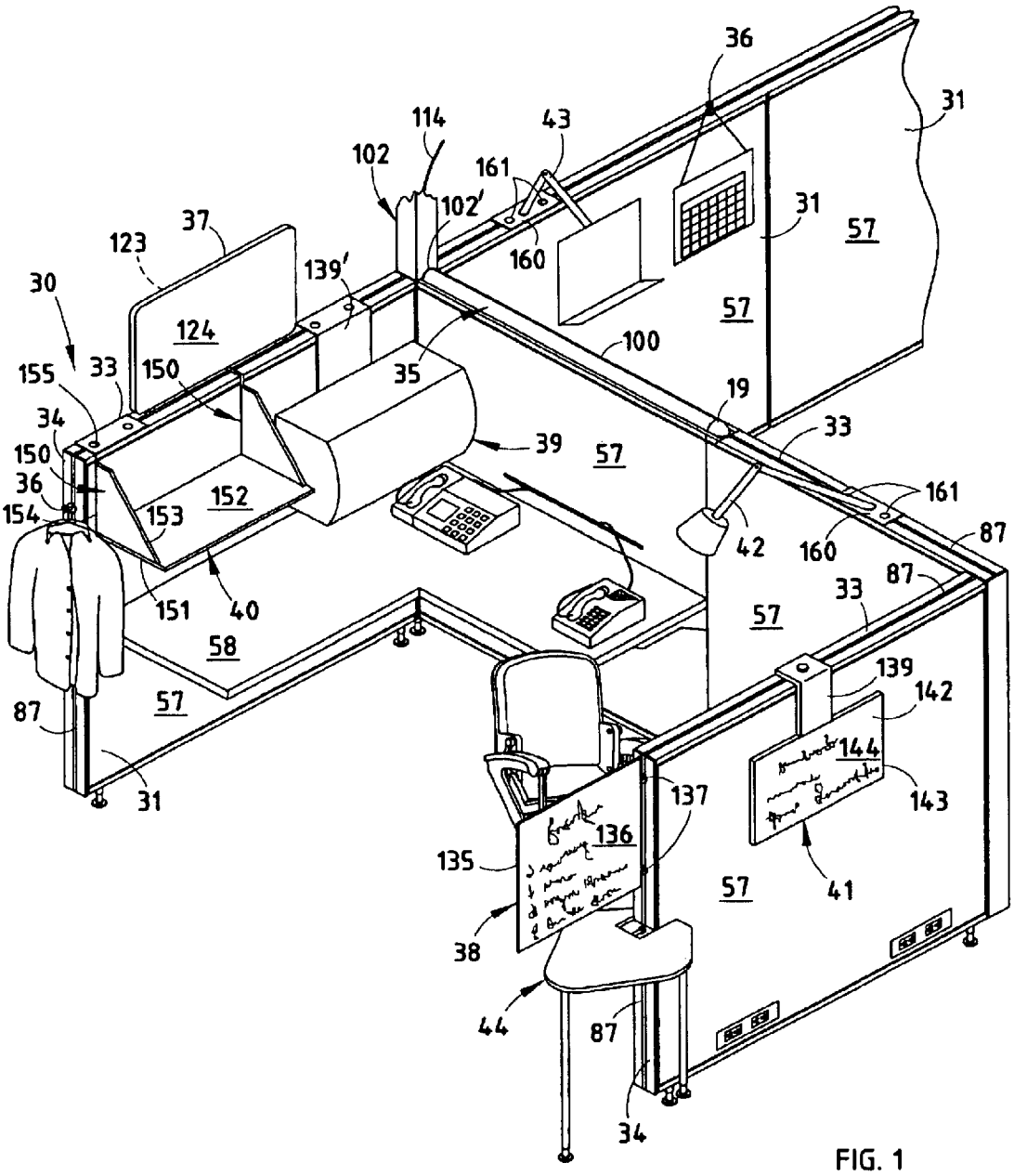
FIG. 1 is a perspective view of an office arrangement including partitions with trim pieces embodying the present invention.
Figure 2:
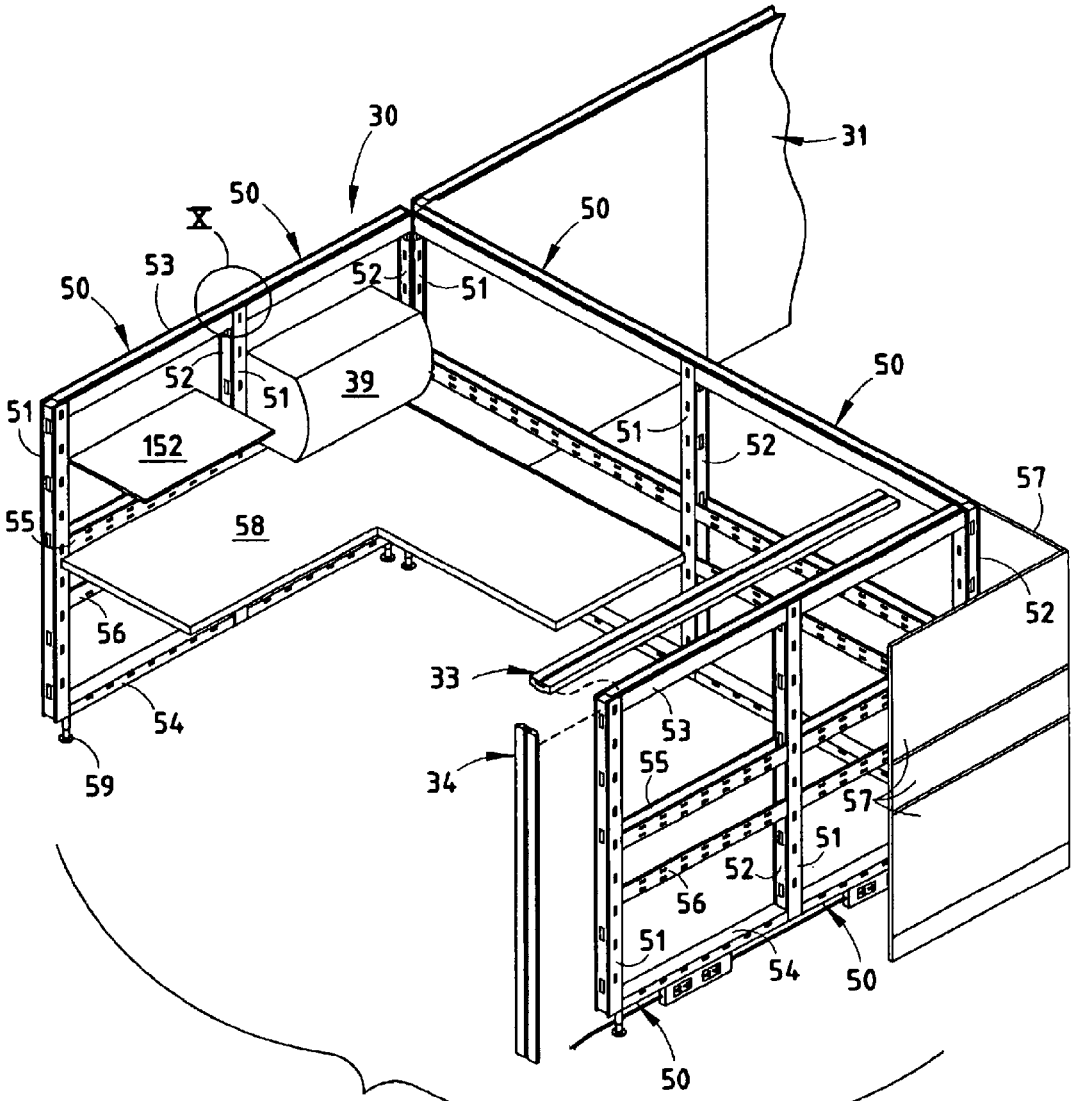
FIG. 2 is a perspective view of the partition frames of FIG. 1, including the top trim piece, end trim piece and side covers exploded away from the closest one of the partitions.
Figure 17:
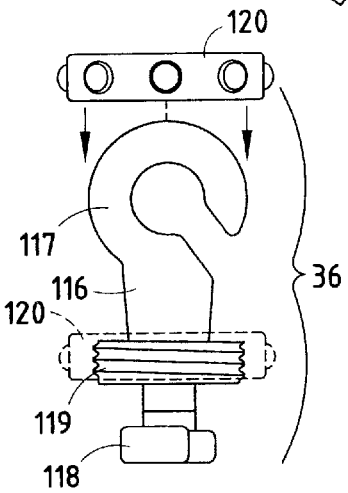
FIGS. 12–16, FIGS. 17–19, FIG. 20, and FIG. 21 show various accessories adapted for engagement with the T-slot of the trim piece of FIG. 1.
Figure 18:
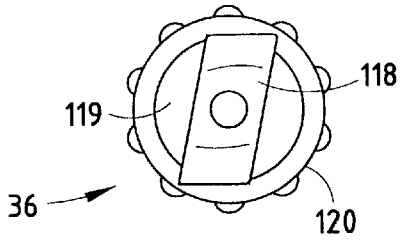
Figure 19:
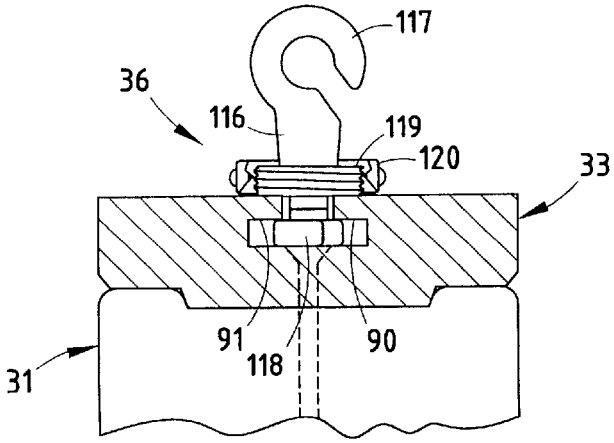
Figure 13:
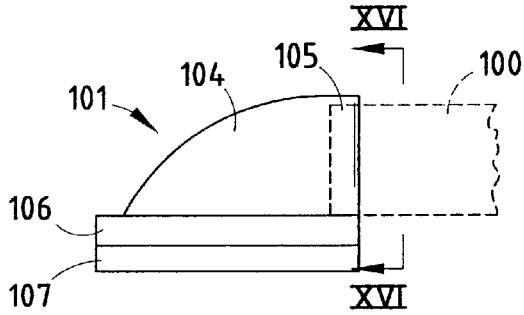
Figure 15:
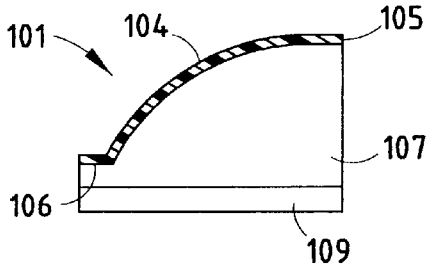
Figure 14:
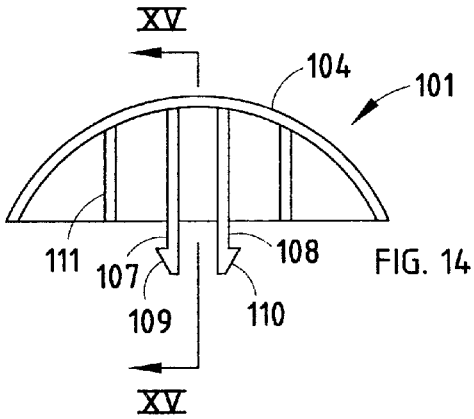
Figure 15A:
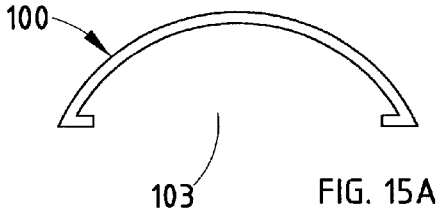
Figure 16:
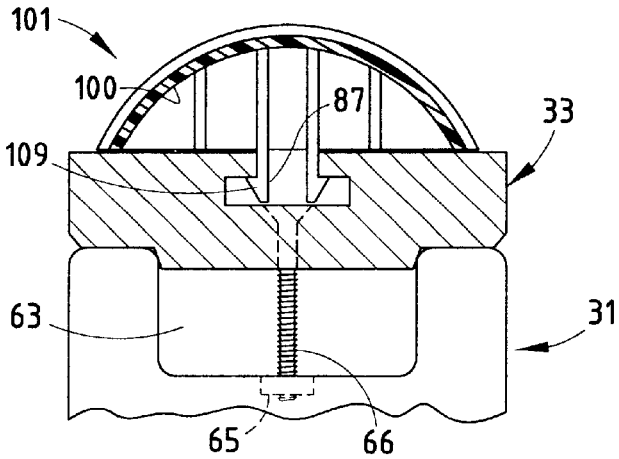
Figure 21:
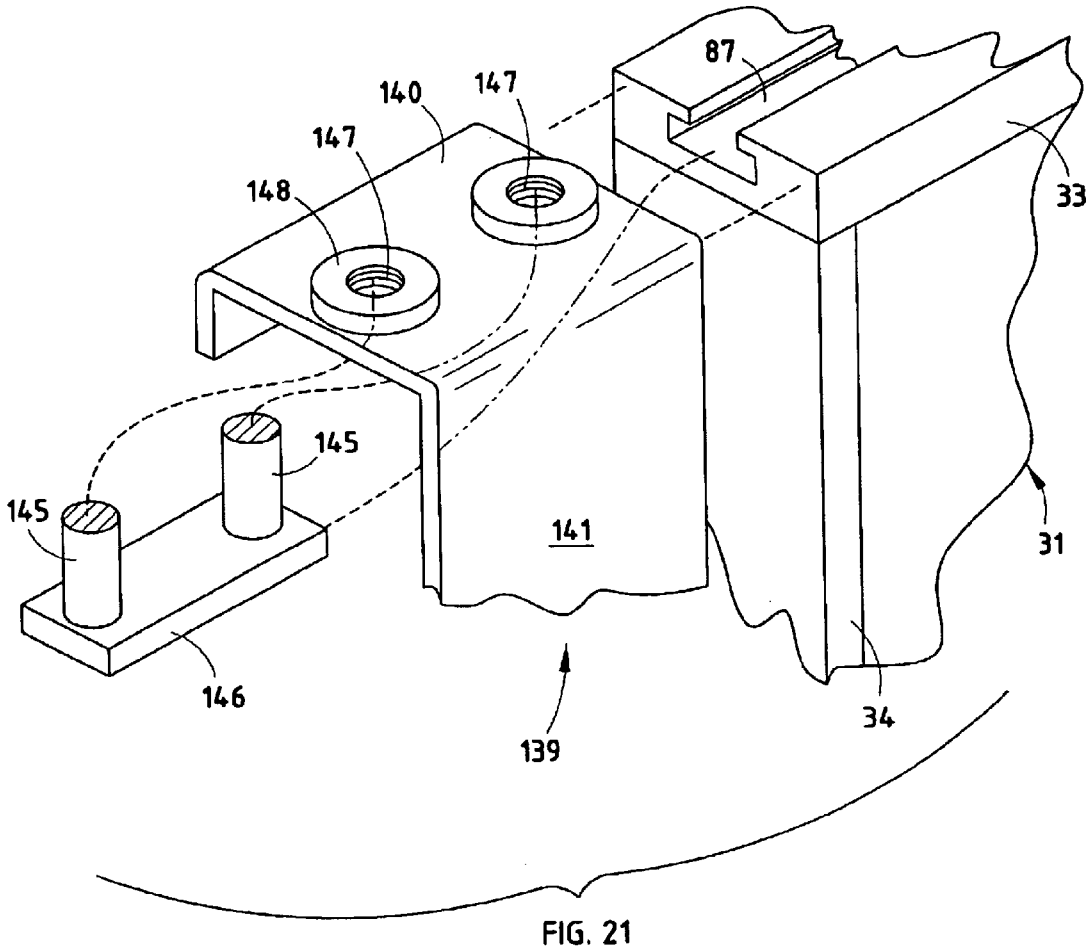
Figure 15B:
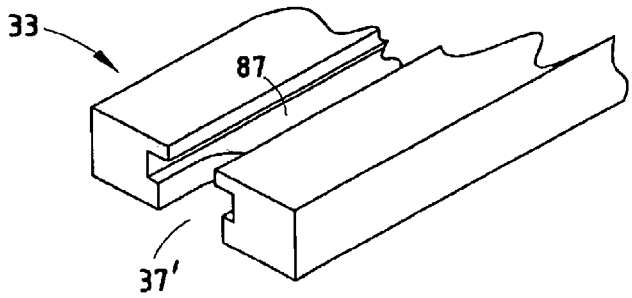
Figure 20:
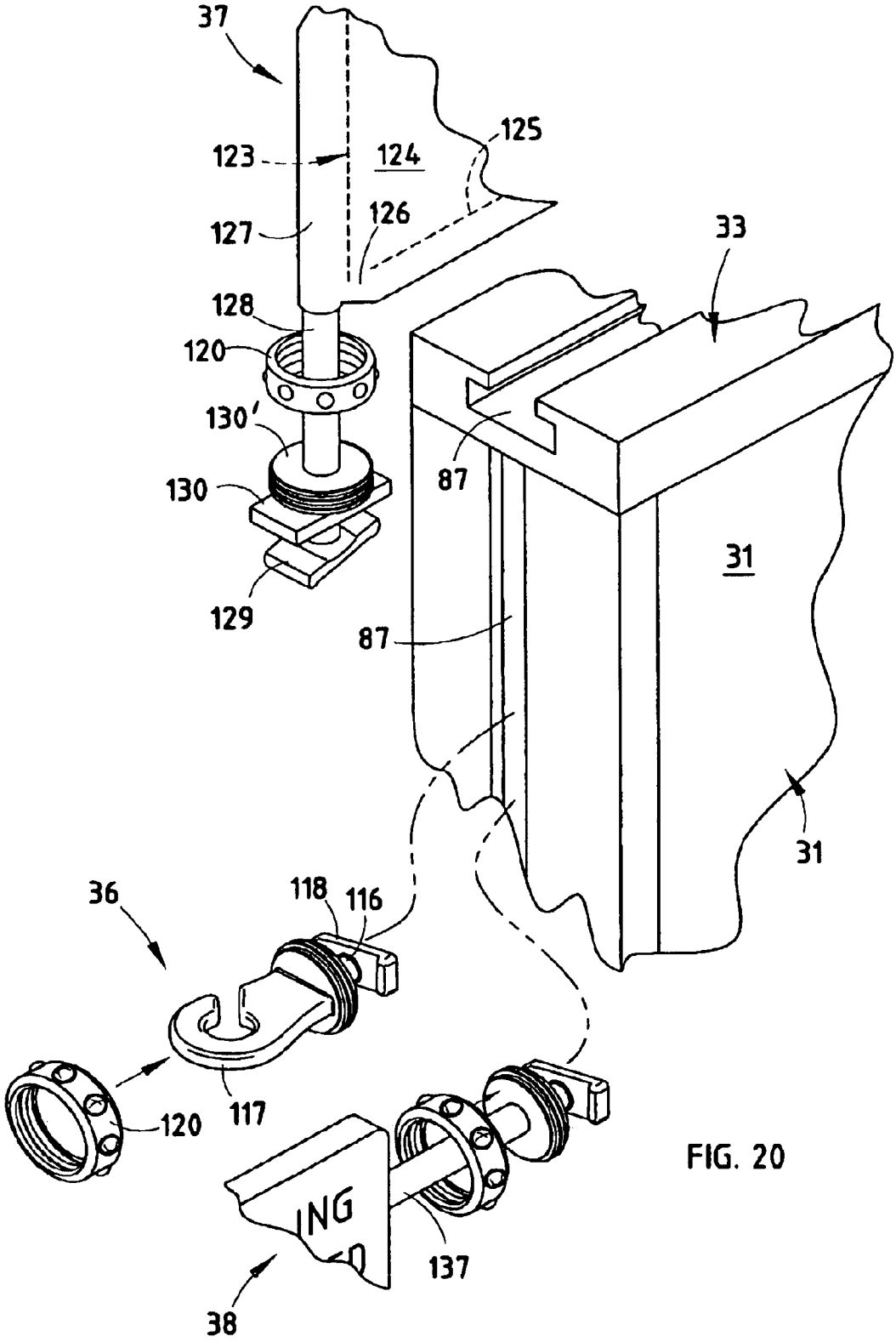

More particularly, in regard to FIGS. 12–21:

FIG. 15 is a cross section taken along the line XV—XV in FIG. 14;

FIG. 15A is an end view of the tunnel-shaped wire manager, which fits into the end piece of the wire manager as shown in FIG. 13 in phantom lines, and FIG. 15B is a perspective view of a top trim piece with a through formed therein for feeding wires from under the tunnel member through the trim piece into an internal cavity of a partition frame;

FIG. 16 is a cross section taken along the line XVI—XVI in FIG. 13, which shows an inner end of the end piece of the wire manager, and its engagement with the T-slot in the trim piece, and the engagement of the tunnel-shaped wire manager with the end piece;

FIGS. 17–18 are side and bottom views of a hook accessory, with FIG. 19 showing engagement of the hook in the T-slot in the trim piece;

FIG. 20 is a fragmentary perspective view of a partition including a T-slot top trim piece and a T-slot end trim piece, and including a top-of-panel mounted screen and its engagement with the T-slot of a top trim piece, and including a side-mounted hook and its engagement with the T-slot of the end trim piece, and including a side-mounted erasable marker board and its engagement with the T-slot of the end trim piece; and FIG. 21 is a perspective view of an inverted L-bracket adapted for mounting a panel on a face of a partition as shown in FIG. 1, including showing its engagement with a T-slot of a top trim piece.

DETAILED DESCRIPTION OF PREFERRED EMBODIMENTS

A partition system 30 (FIG. 1) includes partitions 31 adjustably interconnected and outfitted to form offices. Tops and exposed ends of the partitions 31 are covered with top and end trim pieces 33 and 34, for aesthetically covering and protecting the partitions. The illustrated trim pieces 33 and 34 are made of structural material and have beefed-up sections with elongated T-slots formed in their exposed surface, and further, they are securely attached to the partitions 31. By this arrangement, a plurality of different accessories can be adjustably mounted to tops and ends of the trim pieces 33 and 34 on the partitions 31. The illustrated accessories include a wire manager system 35, a hook 36, a screen 37, an upright/lateral erasable marker board 38, a hanging binder bin 39, a hanging shelf 40, a hanging erasable marker board 41, a top-mounted cantilevered light 42, a top-mounted cantilevered document holder 43, and a side-attached table 44, but it will be clear to persons skilled in the art of furniture after reading the description below that additional accessories can be developed using the present inventive concepts.

The present inventive concepts can be adapted for use on most any partition or wall structure. The illustrated partitions 31 are sufficiently described below for an understanding of the present invention by persons skilled in this art. Nonetheless, additional detailed discussion of the partitions 31, their structure and advantages of their construction can be found in the following patent applications, the entire contents of which are incorporated in their entirety by reference: co-assigned application Ser. No. 10/077,553, filed Feb. 15, 2002, entitled PANEL SYSTEM, and co-assigned application Ser. No. 10/076,709, filed Feb. 15, 2002, entitled PARTITION PANEL WITH MODULAR APPLIANCE MOUNTING ARRANGEMENT.

Figure 5:
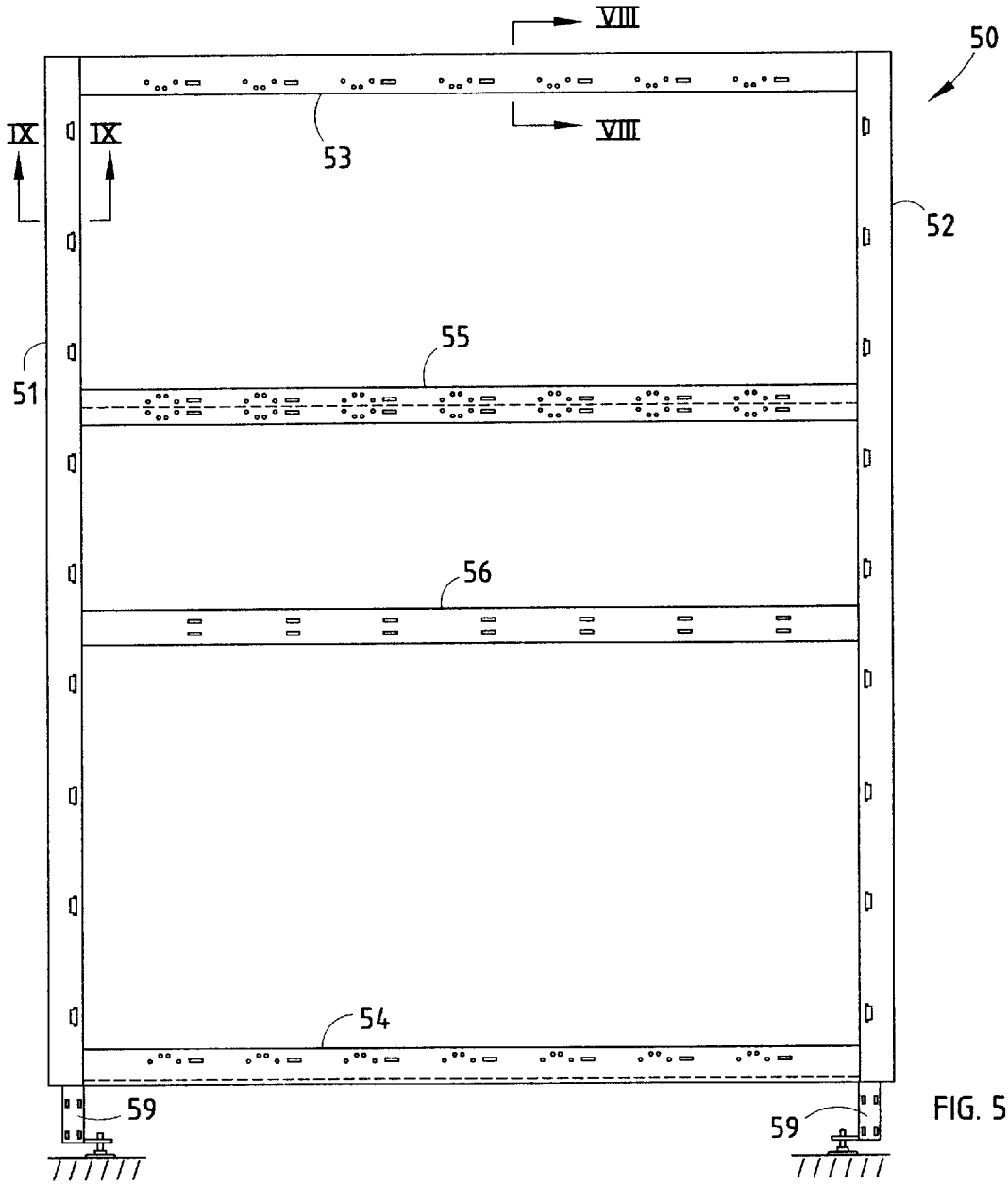
Figure 6:
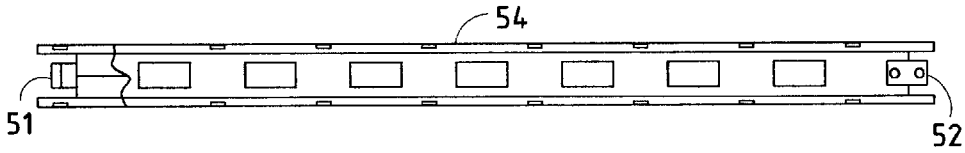
Figure 7:
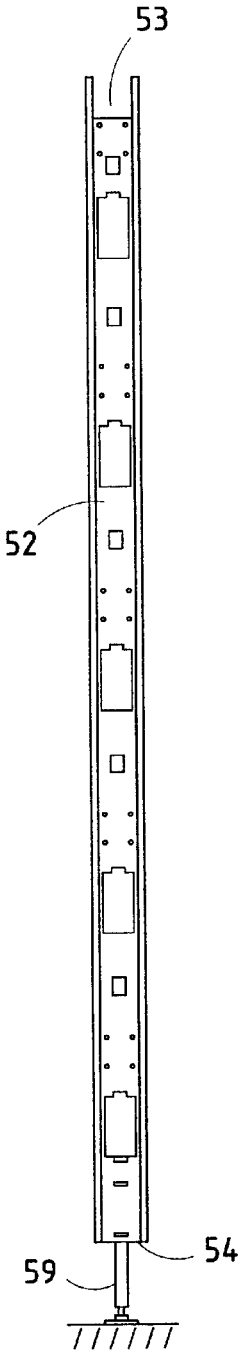

The illustrated partitions 31 (FIG. 5) each include a frame assembly 50 having two end frame members 51 and 52, a top frame member 53, and a bottom frame member 54 forming a perimeter frame. The frame assembly 50 may also include one or more optional intermediate frame members 55, and one or more optional intermediate accessory frame members 56. The frame members 51–56 are covered using removable covers 57 (FIG. 1), and are secured together to form a rigid structure suitable for supporting work surfaces 58, and other furniture and accessories commonly associated with office and subdivision of building space. The illustrated frame assembly 50 further includes adjustable glides or "feet" 59 so that the partitions 31 can be leveled to accommodate unevenness in floors.

Figure 8:
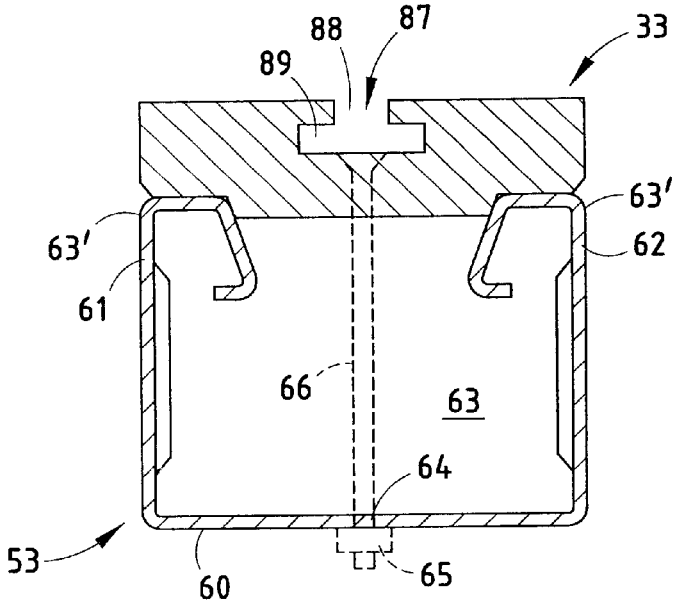
FIGS. 8–9 are cross sections taken along the lines VIII—VIII and IX—IX in FIG. 5.
Figure 11:
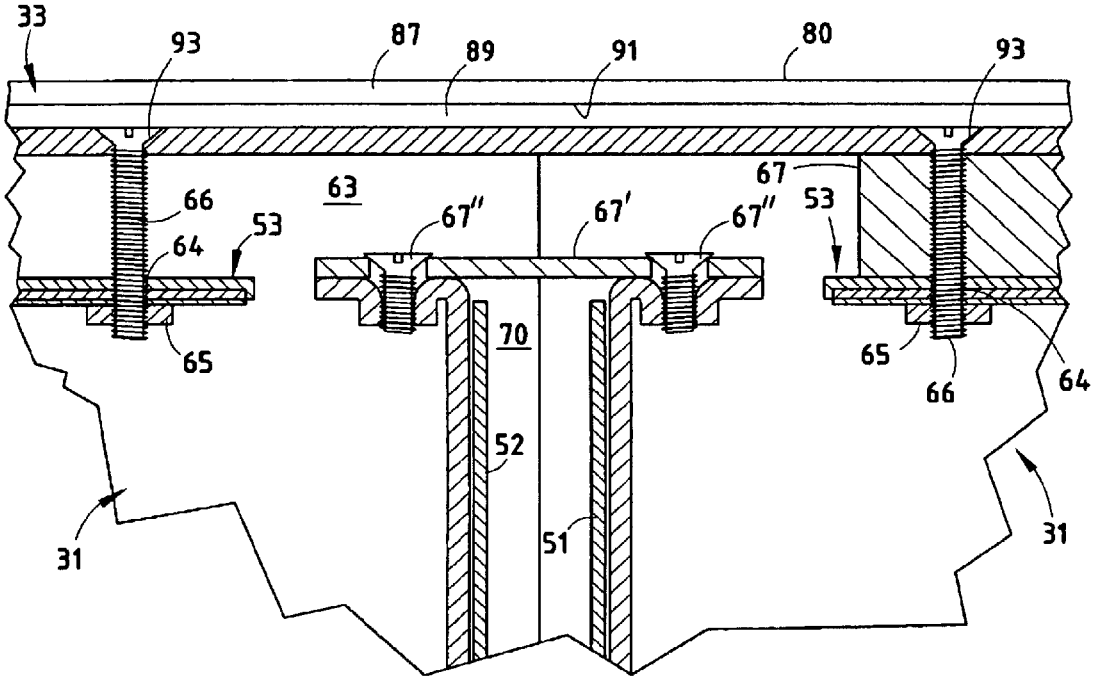
FIG. 11 is a cross section taken along the line XI—XI in FIG. 10, including a trim piece mounted thereto.
Figure 12:
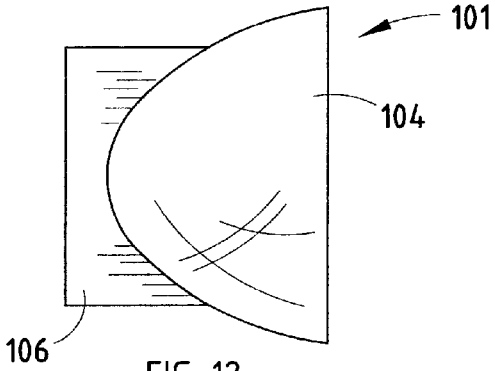

The top frame member 53 (FIG. 8) has a cross section with the flat center wall 60 and upwardly protruding rectangular side ridges 61 and 62 that define a center channel 63 between them. The ridges 61 and 62 include upper/outer corners with a horizontal row of longitudinally-extending short slots 63', which can be engaged with hooked brackets for supporting furniture articles such as binder bins, shelves, and the like. The center wall 60 includes a series of holes 64 with threaded nuts 65 tack-welded under the holes 64. Long bolts 66 are extended through mating holes in the trim piece 33 and threadably into the holes 64 and nuts 65. Depending on a depth of the channel 63, the number of bolts 66, and a lateral strength requirement of the attachment, a foam block 67 (FIG. 11) or similar stabilizer can be added to each connection. If desired, the block 67 can have concave sides to allow for longitudinal passage of wires past the block 67. In FIG. 11, a connector plate 67' extends into channels 63 in adjacent frames 50, and screws 67" secure the connector plate 67' to the frames 50 to align and interconnect the frames 50.

Figure 9:
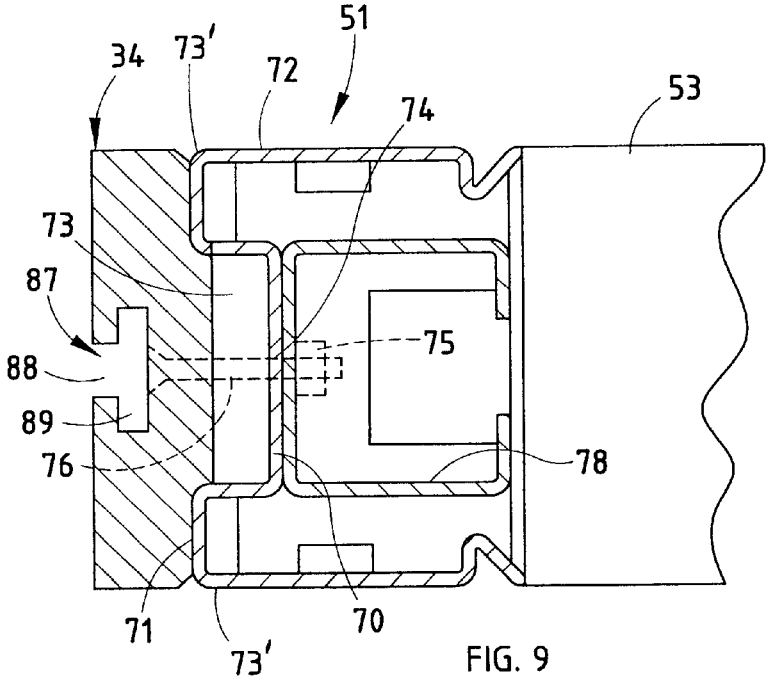
Figure 10:
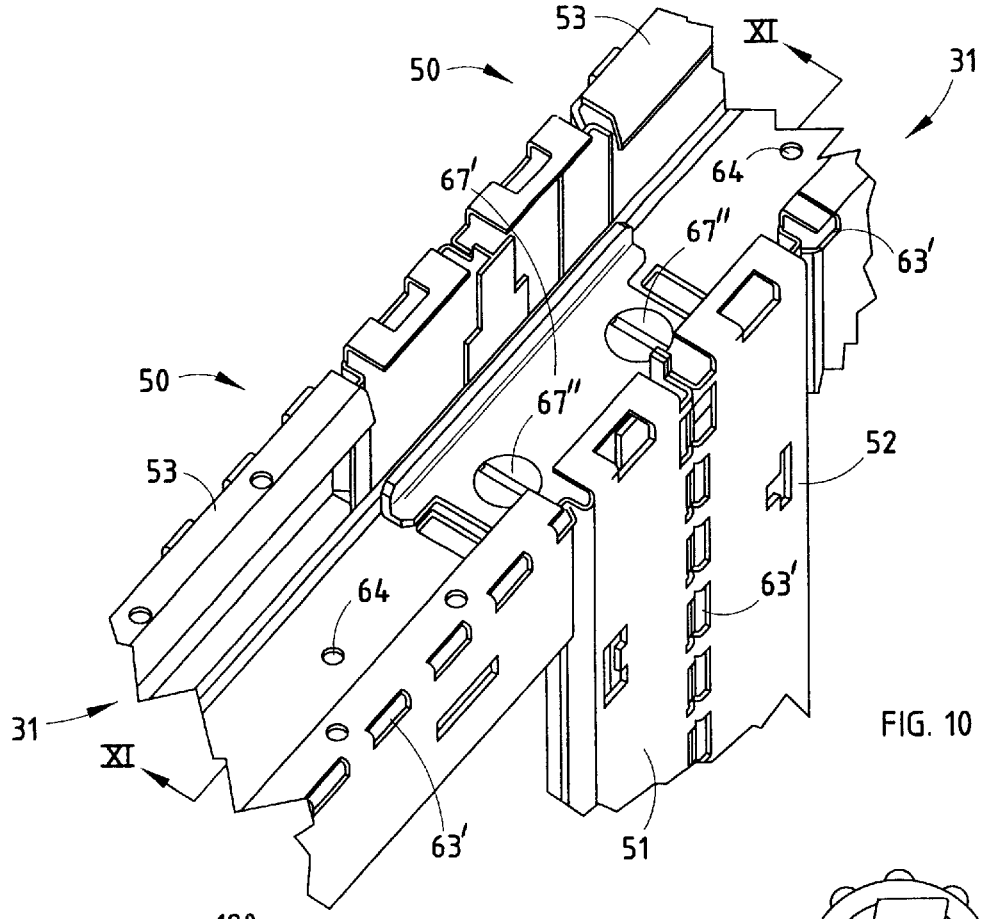
FIG. 10 is an enlarged view of the circled area X in FIG. 2.

The end frame member 51 (and 52) (FIG. 9) is similar to the top frame member 53, although the channel that it defines is much shallower. Specifically, the end frame member 51 includes a cross section with a flat center wall 70, and outwardly protruding rectangular side ridges 71 and 72 that define a channel 73 between them. The ridges 71 and 72 include outer corners with a vertical row of longitudinally-extending short slots 73', which can be engaged with hooked brackets for supporting furniture articles. The center wall 70 includes a series of holes 74 with threaded nuts 75 tack-welded under the holes 74. Long bolts 76 are extended through mating holes in the trim piece 34 and threadably into the holes 74 and nuts 75. Blocks similar to blocks 67 can be used if increased stability of the bolts 76 is needed, but it is contemplated that stabilizing blocks will not be needed due to the short length of the bolts 76. Also, it is noted that the frame members 51 (and 52) are stabilized by a reinforcement 78 under center wall 70 (FIG. 9).

Figure 3:
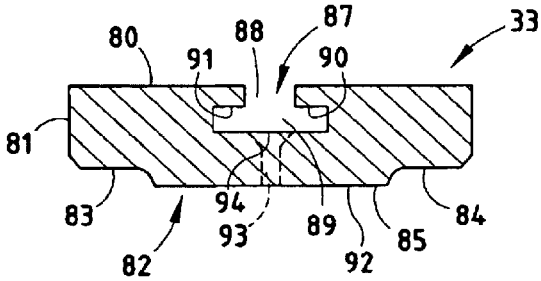
FIG. 3 is a cross section of the trim piece shown in FIG. 2.
Figure 3A:
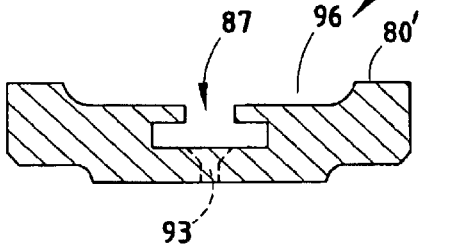
FIG. 3A is a cross section of a modified trim piece similar to FIG. 3 but having a top recess.
Figure 4:
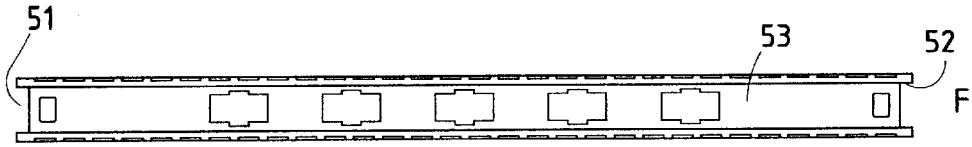
FIGS. 4–7 are top, side, bottom, and end views of a partition frame from FIG. 2.

The top trim piece 33 (FIG. 3) has a width and length chosen to cover a top surface of the partition 31. Notably, the length of the top trim pieces 33 can be longer or shorter than individual partitions 31, as long as a total length equals a length of an interconnected run of partitions 31. (Notice in FIG. 1 that some top trim pieces 33 span two partitions 31.) The illustrated trim piece 33 (FIG. 3) includes flat top and side surfaces 80 and 81, and includes a bottom surface 82 with flat landings 83 and 84 for resting on the protruding ridges 61 and 62. The bottom surface 82 further includes a down-ridge 85 that extends partially into the channel 63. The down-ridge 85 has a width so that its edges abut the inside corners of the ridges 61 and 62, thus centering the trim piece 33 on the top frame member 53. If increased stability is desired, the outer edges of the side surfaces 80 and 81 can include a down lip so that the protruding ridges 61 and 62 are positively captured. A top surface of the top trim piece 33 is relatively flat, with the exception of a center area where the T-slot 87 is formed. The T-slot 87 includes a neck portion 88 and a wide portion 89 with blind surfaces 90 and 91. A bottom flange 92 forms a bottom of the T-slot 87. Holes 93 are bored through the bottom flanges 92, and each includes a recess 94 for receiving a head of the bolt 66. By this arrangement, when the bolts 66 are in an assembled position, the head of the bolt 66 is removed from the T-slot 87, so that the bolt 66 does not interfere with use of the T-slot 87. It is also noted that the top trim piece 33 could be attached by extending screws through the top trim piece 33 at positions outside the T-slot 87 and into the side ridges 61 and 62.

A cross sectional shape of the trim piece 33 can be varied for aesthetics and functional reasons. The illustrated cross sections shape of trim piece 33 includes a flat top surface 80 and flat side surfaces 81 that define a rectangular shape. However, the top surface can be modified as shown by top trim piece 33A, which includes top surface 80' with a dish-shaped recess 96. This dish shape has an aesthetic appeal, and when used with the wire manager system 35, also provides increased room for routing wiring along a top of the partition 31, as described below. It is noted that the trim piece 33 can span aligned adjacent partitions 31 (see FIG. 1, the top left two partitions). It is also noted that the dish-shaped recess 96 could be divided in half by a vertical flange, so as to subdivide and separate recess 96 into two channels, one being for communication wiring and one being for power electrical wiring.

The illustrated slots 87 work particularly well, since accessories can be positioned anywhere along the top or ends of the partitions 31. However, a scope of the present inventive concepts is believed to include other attachment features, such as a protruding ridge (e.g. a T-shaped ridge), a plurality of discrete locations instead of continuous slot (e.g. a series of holes or short slots, not unlike the slots 63' in top frame member 53). Hook and loop material could also be used.

The illustrated end trim piece 34 (FIG. 9, but also see FIGS. 1 and 3) has the same cross sectional shape as the top trim piece 33, and accordingly, a second description is not necessary for an understanding of trim piece 34. The illustrated end trim piece 33 is interchangeable with top trim piece 33, except perhaps for its length, which will vary depending upon the partitions 31.

As noted above, the illustrated accessories include a wire manager system 35, a hook 36, a screen 37, an erasable marker board 38, a hanging binder bin 39, a hanging shelf 40, a hanging erasable marker board 41, a top-mounted cantilevered light 42, a top-mounted cantilevered document holder 43, and a side-attached table 44. Each accessory includes at least one anchor that operably engages a blind surface in the T-slot and further includes a base opposing the anchor, so that as the anchor is drawn toward the base, the arrangement clampingly and stably retains the accessory to an exposed outer surface of the trim piece 33 (or 34) and hence to the associated partition 31. Depending on the functional needs of the accessory, such as the need for stability, the need to provide torque to resist lateral forces (such as may occur when a person is writing on an erasable marker board), the need for styling and/or aesthetics, and other considerations, the visible portion of the base can be varied, or multiple bases and anchors can be used, or both.

The illustrated wire manager system 35 (FIG. 1) includes a tunnel element 100, a terminator element 101, and an overhead-utility down-feed element 102. The overhead-utility down-feed element 102 is adapted to communicate utilities, such as wires, downwardly from a ceiling or from an overhead framework of a post-and-beam furniture system. The tunnel element 100 has an inverted U-shaped cross sectional shape (FIG. 15A) that forms an inner passageway 103, and has a width selected so that the legs of the U-shape can rest on a top trim piece 33 of a partition 31. A through hole or aperture 37' (FIG. 15B) can be cut through the trim piece 33 (or 34) to allow wires to pass through the trim piece 37 down into an internal cavity of the partition 31. The overhead-utility down-feed element 102 (FIG. 1) includes a side wall facing the direction of the tunnel element 100, with a cut-out 102' shaped to mateably engage the tunnel element 100, such that the tunnel element 100 can be extended into the cut-out for optimal aesthetics. At the other end of the tunnel element 100, the terminator element 101 is positioned. The terminator element 101 (FIGS. 12–16) has a half-cup-shaped body 104 with a lip 105 forming an open mouth for receiving the end of the tunnel element 100. A base flange 106 extends around the down side of the body 104, and is adapted to rest on the top trim piece 33. A first pair of legs 107 and 108 extend downwardly from a middle area of the cup-shaped body 104. The legs 107 and 108 are resilient, and include hooks 109 and 110 on their ends that are shaped to releasably engage opposing sides of the T-slot 87 to retain the body 104 on the top trim piece 33. Additional secondary legs 111 can be located between the legs 107 and the sides of the body, for providing additional stability and strength to the body 104. It is noted that the tunnel element 100 can extend longer or shorter than the partition 31, and longer or shorter than the top trim 33 on which it rests.

In FIG. 1, the down-feed element 102 drops wires 114 to one end of the partition 31, and the tunnel element 100 extends across a top of and past that partition 31 onto the top of a second partition 31. This allows wires 114 located within the tunnel element 100 to be communicated across a top of the first partition 31 and then down into the second partition 31, without having to route the wiring through the first partition 31 into the second partition 31. (The wires 114 are extended along the T-slot 87 to light 42.) This arrangement of wire management greatly facilitates office rearrangements, since the wiring is easy to reach, see, and re-route.

The hook 36 (FIGS. 17–19) includes a center stem 116 with a hook element 117 on one end and a transverse segment or anchor 118 on its other end. The stem 116 and anchor 118 form an inverted T-shape. A base or disk 119 is attached to the center stem 116 at a location spaced from the anchor 118. The outside of the disk 119 is threaded, and a nut 120 is threaded onto the disk 119. To insert the hook 36 into the T-slot, the anchor 118 is oriented so that it aligns with the neck portion 88 of the T-slot 87. In this position, the anchor 118 fits through the neck portion 88 of the T-slot 87. The stem 116 and anchor 118 are then rotated 90-degrees, which causes the anchor 118 to move into the wide portion 89 of the slot 87, with its ends engaging the blind surfaces 90 and 91 on the T-slot 87. The nut 120 is then rotated while the hook element 117 is held stationary, such that the nut 120 threadably moves downwardly on the disk 119 until the nut 120 clamps against the marginal material of the top trim piece 33 forming the neck portion 88. Due to a width of the hut 120 and of the anchor 118, the hook 36 is stably held on the top trim piece 33. The hook 36 can similarly be attached to the end trim piece 34 (see FIG. 1).

The screen 37 (FIG. 20) includes a bent wire frame 123 covered with a screen fabric material 124. The frame 123 includes a lower horizontal frame member 125 with an up-bend 126 at its corners. The frame 123 includes side frame members 127 with foot sections 128 that extend below the up-bend 126. The foot sections 128 are not unlike the stem 116. The foot sections 128 include a transverse segment or anchor 129 on its other end, which forms an inverted T-shape. A base 130 is attached to the foot section 128 at a location spaced from the anchor 129. The base 130 includes a disk 130' that is threaded, and a nut 131 that is threaded onto the disk 130'. To insert the anchor 129 into the T-slot, the anchor 129 is oriented so that it aligns with the wide portion 89 of the T-slot 87. In this position, the anchor 129 slops into an end of the T-slot, with the anchor 129 engaging the blind surfaces 90 and 91 on the T-slot 87. The nut 131 is then rotated while the frame 123 is stationary, such that the nut 131 threadably moves downwardly on the disk 130' until the nut 131 clamps against the marginal material of the top trim piece 33 forming the neck portion 88. Due to a width of the nut 131 and of the anchor 129, the screen 37 is stably held on the top trim piece 33. The screen 37 can similarly be attached to the end trim piece 34 (see FIG. 1). In such case, the screen 37 extends laterally outward from the partition 31 in a plane of the partition 31.

Two erasable marker boards 38 and 41 are shown in FIG. 1, with marker board 38 extending laterally or upwardly from the partition 31, and the marker board 41 lying against a face of the partition 31. Specifically, the marker board 38 includes a perimeter channel frame 135 with white erasable marker board material 136 inside the channel frame 135. Two legs 137 extend laterally from the perimeter channel frame 135. Each include a threaded stem, an anchor, a base/disk, and a threaded nut, similar to those described above for the screen 37. The marker board 38 can be attached to the top trim piece 33 or to the end trim piece 34 (as shown), and extends outwardly from the partition 31. The marker board 41 includes an L-shaped bracket 139 (FIG. 21) having a top leg 140 (FIG. 21) that extends across the top trim piece 33. A pair of stems 145, anchors 146, disks 147, and threaded nuts 148 extend from the top leg 140 for clamping engagement with the T-slot 87 on the top trim piece 33. The bracket 139 includes a down leg 141 that extends downwardly flush against a face of the partition 31. The down leg 141 has a length so that it positions an erasable surface 142 (FIG. 1) at a desired height on the face of the partition 31. The illustrated erasable board 41 has a perimeter channel frame 143 and a white erasable surface 144 like the marker board 38.

The hanging binder bin 39 (FIG. 1) is mounted on an L-bracket 139' similar to the L-bracket 139 for the erasable marker board, but the L-bracket 139' is beefed up for the additional weight that it is likely to carry. A pair of brackets 139' can be used if necessary to support the binder bin 149.

The hanging shelf 40 (FIG. 1) is mounted on a pair of bent wire side supports 150. The supports 150 have a triangular end with a horizontal segment 151 adapted to carry a shelf panel 152 in a horizontal position. The supports 150 further have an angled segment 153 to a top tip at the top trim piece 33. A rear leg of bent wire 155 extends from the top tip across a top of the top trim piece 33, and includes a stem, an anchor, a base/disk, and a threaded nut, as previously describe.

The top-mounted cantilevered light 42 and the top-mounted cantilevered document holder 43 each include a panel base plate 160 that engages a top of the top trim piece 33. Each include a stem, anchor, (base plate 160), and at least one nut 161 for clamping retention to the T-slot 87 of the top trim piece 33.

It is contemplated that furniture can be attached to the slots 87. For example, the side-attached table 44 includes a stem, anchor, base, and nut for retaining the table 44 adjacent the end trim piece 34 of the partition 31. It is contemplated that benches, chairs, or the like could also be coupled to or tethered to the partition 31.

An advantage of mounting the accessories 35–44 anywhere along the partitions 31 is that it provides infinite and easy adjustability. This lets the office worker locate accessories in optimal locations and positions for workflow, and lets the worker adjust for changing needs and preferences. Customization of an office leads to individuality, identity, and personality of a workspace, as well as pride and ownership of the space. The user can easily adjust his office to changing needs without requiring skilled trades assistance in order to make the change. Further, the accessories are mounted in areas not previously used, such as areas directly above the partitions and off free ends of the partitions, which areas were previously wasted space and/or at least underutilized.

Additional accessories are shown in a commonly-assigned patent application Ser. No. 10/113,124, filed on Mar. 29, 2002 (same day as present application), entitled BUILDING OUTFITTING SYSTEM WITH COMMON ACCESSORY MOUNTING FEATURE, and the entire contents of that application are incorporated herein in its entirety by reference.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. In a reconfigurable partition system of the type having panels detachably interconnected to define individual workstations, wherein said panels include at least one frame with a top member, opposite end members and side faces enclosed by cover panels, the improvement of an apparatus for selectively accessorizing the workstations, comprising:

at least one accessory having an anchor portion thereof adapted to detachably mount said accessory on an associated one of said panels, and an accessory portion thereof configured to equip an associated one of the workstations;

an elongated top trim member extending along and aesthetically covering the top member of said frame, and including an outwardly opening attachment slot extending along at least a substantial portion of the length of said top trim member, with a predetermined configuration to receive the anchor portion of said accessory therein for selectively mounting said accessory at one of a variety of positions along said top trim member;

a first fastener member detachably yet rigidly attaching said top trim member to the top member of said frame;

an elongated end trim member extending along and aesthetically covering one of the end members of said frame, and including an outwardly opening attachment slot extending along at least a substantial portion of the length of said end trim member, with a predetermined configuration to receive the anchor portion of said accessory therein for selectively mounting said accessory at one of a variety of positions along said end trim member;

a second fastener member detachably yet rigidly attaching said end trim member to the one end member of said frame; and wherein said predetermined configuration of said attachment slot on said top trim member is substantially identical with said predetermined configuration of said attachment slot on said end trim member, such that said anchor portion of said accessory can be received within both to detachably mount said accessory either on said top trim member in a generally horizontal orientation or on said end trim member in a generally vertical orientation.

2. A partition system as set forth in claim 1, wherein:

said anchor portion of said accessory has an inverted T-shape to positively yet detachably mount said accessory on said one panel.

3. A partition system as set forth in claim 2, wherein:

said predetermined configuration of said attachment slot on said top trim member and said end trim member is T-shaped, and sized to closely receive said anchor portion of said accessory therein.

4. A partition system as set forth in claim 3, wherein:

said accessory includes a plurality of accessories, each having a similarly configured anchor portion to attach to both of said top trim member and said end trim member, and a differently configured accessory portion to variously equip the workstations.

5. A partition system as set forth in claim 4, wherein:

said accessories include a hook having a hook-shaped free end thereof shaped to hang items thereon.

6. A partition system as set forth in claim 5, wherein:

said hook includes a threaded base engaged by a similarly threaded nut to selectively clamp said hook on one of said top trim member and said end trim member.

7. A partition system as set forth in claim 6, wherein:

said accessories include a privacy screen.

8. A partition system as set forth in claim 7, wherein:

said accessories include a marker board.

9. A partition system as set forth in claim 8, wherein:

said accessories include a wire manager.

10. A partition system as set forth in claim 7, wherein:

said attachment slot extends along a central portion of said top trim member.

11. A partition system as set forth in claim 10, wherein:

said attachment slot extends along a central portion of said end trim member.

12. A partition system as set forth in claim 11, wherein:

said top member of said frame has a predetermined width; and said top trim member has a width substantially commensurate with the predetermined width of said frame top member to fully cover the same.

13. A partition system as set forth in claim 12, wherein:

said one end member of said frame has a predetermined width; and said end trim member has a width substantially commensurate with the predetermined width of said frame one end member to fully cover the same.

14. A partition system as set forth in claim 13, wherein:

said frame has an open interior.

15. A partition system as set forth in claim 14, wherein:

said frame is rigid, and includes a generally rectangular elevational shape.

16. A partition system as set forth in claim 15, wherein:

said cover panels have a generally rectangular shape, and are detachably mounted on said frame.

17. A partition system as set forth in claim 16, wherein:

each of said panels includes a rigid, rectangular frame with opposed end members adapted for detachable connection with the end member of an adjacent one of said frames.

18. A partition system as set forth in claim 1, wherein:

said predetermined configuration of said attachment slot on said top trim member and said end trim member is T-shaped.

19. A partition system as set forth in claim 1, wherein:

said accessory includes a plurality of accessories, each having a similarly configured anchor portion to attach to both of said top trim member and said end trim member, and a differently configured accessory portion to variously equip the workstations.

20. A partition system as set forth in claim 1, wherein:

said accessory comprises a hook having a hook-shaped free end thereof shaped to hang items thereon.

21. A partition system as set forth in claim 20, wherein:

said hook includes a threaded base engaged by a similarly threaded nut to selectively clamp said hook on one of said top trim member and said end trim member.

22. A partition system as set forth in claim 1, wherein:

said accessory comprises a privacy screen.

23. A partition system as set forth in claim 1, wherein:

said accessory comprises a marker board.

24. A partition system as set forth in claim 1, wherein:

said accessory comprises a wire manager.

25. A partition system as set forth in claim 1, wherein:

said frame is rigid, has an open interior, and includes a generally rectangular elevational shape.

26. A partition system as set forth in claim 1, wherein:

said cover panels have a generally rectangular shape, and are detachably mounted on said frame.

27. A partition system as set forth in claim 1, wherein:

each of said panels includes a rigid, rectangular frame with opposed end members adapted for detachable connection with the end member of an adjacent one of said frames.

28. An apparatus for accessorizing a reconfigurable partition system of the type having panels detachably interconnected to define individual workstations, comprising:

at least one accessory having an anchor portion thereof adapted to detachably mount said accessory on an associated one of the panels, and an accessory portion thereof configured to equip an associated one of the workstations;

an elongated top trim member shaped to extend along and aesthetically cover a top frame member of the panel, and including an outwardly opening attachment slot extending along at least a substantial portion of the length of said top trim member, with a predetermined configuration to receive the anchor portion of said accessory therein for selectively mounting said accessory at one of a variety of positions along said top trim member;

a first fastener member adapted to detachably yet rigidly attach said top trim member to the top member of the frame;

an elongated end trim member shaped to extend along and aesthetically cover an end frame member of the panel, and including an outwardly opening attachment slot extending along at least a substantial portion of the length of said end trim member, with a predetermined configuration to receive the anchor portion of said accessory therein for selectively mounting said accessory at one of a variety of positions along said end trim member;

a second fastener member adapted to detachably yet rigidly attach said end trim member to the end member of the frame; and wherein said predetermined configuration of said attachment slot on said top trim member is substantially identical with said predetermined configuration of said attachment slot on said end trim member, such that said anchor portion of said accessory can be received within both to detachably mount said accessory either on said top trim member in a generally horizontal orientation or on said end trim member in a generally vertical orientation.

29. An apparatus as set forth in claim 28, wherein:

said anchor portion of said accessory has an inverted T-shape to positively yet detachably support said accessory.

30. An apparatus as set forth in claim 29, wherein:

said predetermined configuration of said attachment slot on said top trim member and said end trim member is T-shaped, and sized to closely receive said anchor portion of said accessory therein.

31. An apparatus as set forth in claim 30, wherein:

said accessory includes a plurality of accessories, each having a similarly configured anchor portion to attach to both of said top trim member and said end trim member, and a differently configured accessory portion to variously equip the workstations.

32. An apparatus as set forth in claim 31, wherein:

said accessories include a hook having a hook-shaped free end thereof shaped to hang items thereon.

33. A apparatus as set forth in claim 32, wherein:

said hook includes a threaded base engaged by a similarly threaded nut to selectively clamp said hook on one of said top trim member and said end trim member.

34. An apparatus as set forth in claim 33, wherein:

said accessories include a privacy screen.

35. An apparatus as set forth in claim 34, wherein:

said accessories include a marker board.

36. An apparatus as set forth in claim 35, wherein:

said accessories include a wire manager.

37. An apparatus as set forth in claim 36, wherein: said attachment slot extends along a central portion of said top trim member and said end trim member.

38. In a reconfigurable partition system of the type having panels detachably interconnected to define individual workstations, wherein said panels include at least one frame with a top member, opposite end members and side faces enclosed by cover panels, the improvement of an apparatus for selectively accessorizing the workstations, comprising:

at least one accessory having an anchor portion thereof adapted to detachably mount said accessory on an associated one of said panels, and an accessory portion thereof configured to equip an associated one of the workstations;

an elongated top trim member extending along and aesthetically covering the top member of said frame, and including an attachment member extending along at least a substantial portion of the length of said top trim member, with a predetermined configuration to connect with the anchor portion of said accessory therein for selectively mounting said accessory at one of a variety of positions along said top trim member;

a first fastener member detachably yet rigidly attaching said top trim member to the top member of said frame;

an elongated end trim member extending along and aesthetically covering one of the end members of said frame, and including an attachment member extending along at least a substantial portion of the length of said end trim member, with a predetermined configuration to connect with the anchor portion of said accessory therein for selectively mounting said accessory at one of a variety of positions along said end trim member;

a second fastener member detachably yet rigidly attaching said end trim member to the one end member of said frame; and wherein said predetermined configuration of said attachment member on said top trim member is substantially identical with said predetermined configuration of said attachment member on said end trim member, such that said anchor portion of said accessory can be connected with both to detachably mount said accessory either on said top trim member in a generally horizontal orientation or on said end trim member in a generally vertical orientation.

39. A partition system as set forth in claim 38, wherein:

said accessory includes a plurality of accessories, each having a similarly configured anchor portion to attach to both of said top trim member and sand end trim member, and a differently configured accessory portion to variously equip the workstations.

40. A partition system as set forth in claim 39, wherein:

said accessories include a hook having a hook-shaped free end thereof shaped to hang items thereon.

41. A partition system as set forth in claim 40, wherein:

said hook includes a threaded base engaged by a similarly threaded nut to selectively clamp said hook on one of said top trim member and said end trim member.

42. A partition system as set forth in claim 41, wherein:

said accessories include a privacy screen.

43. A partition system as set forth in claim 42, wherein:

said accessories include a marker board.

44. A partition system as set forth in claim 43, wherein:

said accessories include a wire manager.

45. A partition system as set forth in claim 44, wherein:

said frame has an open interior.

46. A partition system as set forth in claim 45, wherein:

said frame is rigid, and includes a generally rectangular elevational shape.

47. A partition system as set forth in claim 46, wherein:

said cover panels have a generally rectangular shape, and are detachably mounted on said frame.

48. A partition system as set forth in claim 47, wherein:

each of said panels includes a rigid, rectangular frame with opposed end members adapted for detachable connection with the end member of an adjacent one of said frames.

* * * * *